US008294547B2

(12) United States Patent
Feichtinger et al.

(10) Patent No.: US 8,294,547 B2
(45) Date of Patent: Oct. 23, 2012

(54) METHOD FOR INCREASING THE ESD PULSE STABILITY OF AN ELECTRICAL COMPONENT

(75) Inventors: Thomas Feichtinger, Graz (AT); Markus Albrecher, St. Stefan (AT); Thomas Puerstinger, Graz (AT); Guenter Engel, Leibnitz (AT)

(73) Assignee: Epcos AG, Munich (DE)

( * ) Notice: Subject to any disclaimer, the term of this patent is extended or adjusted under 35 U.S.C. 154(b) by 0 days.

(21) Appl. No.: 13/007,078

(22) Filed: Jan. 14, 2011

(65) Prior Publication Data

US 2011/0163842 A1 Jul. 7, 2011

Related U.S. Application Data

(63) Continuation of application No. PCT/EP2009/059081, filed on Jul. 15, 2009.

(30) Foreign Application Priority Data

Jul. 16, 2008 (DE) ..... 10 2008 033 392

(51) Int. Cl.
*H01C 7/10* (2006.01)

(52) U.S. Cl. ..... 338/20; 702/182; 324/512

(58) Field of Classification Search ..... 338/20; 702/65, 182, 188; 324/500, 512, 522, 532, 324/755

See application file for complete search history.

(56) References Cited

U.S. PATENT DOCUMENTS

| | | | | |
|---|---|---|---|---|
| 4,080,571 | A * | 3/1978 | Weisbrod | 324/762.07 |
| 5,675,260 | A | 10/1997 | Consiglio | |
| 5,966,645 | A * | 10/1999 | Davis | 455/108 |
| 5,978,197 | A * | 11/1999 | Chan | 361/111 |
| 6,930,501 | B2 * | 8/2005 | Bargstadt-Franke et al. | 324/750.3 |
| 7,821,272 | B2 * | 10/2010 | Scholz et al. | 324/601 |
| 7,928,737 | B2 * | 4/2011 | Hernandez | 324/527 |
| 2004/0239346 | A1 | 12/2004 | Iyer et al. | |

FOREIGN PATENT DOCUMENTS

| | | |
|---|---|---|
| EP | 0 033 155 B1 | 8/1981 |
| EP | 1 015 895 B1 | 7/2000 |

OTHER PUBLICATIONS

Barth, J. E., et al., "TLP Calibration, Correlation, Standards, and New Techniques," IEEE Transactions on Electronics Packaging Manufacturing, Apr. 2001, pp. 99-108, vol. 24, No. 2.

Grund, E., et al., "TLP Systems with Combined 50- and 500-Ω Impedance Probes and Kelvin Probes," IEEE Transactions on Electronics Packaging Manufacturing, Jul. 2005, pp. 213-223, vol. 28, No. 3.

* cited by examiner

*Primary Examiner* — Kyung Lee
(74) *Attorney, Agent, or Firm* — Slater & Matsil, L.L.P.

(57) ABSTRACT

A method for increasing the ESD pulse stability of an electrical component is disclosed. An electrical component is pre-aged by means of an aging pulse generated by a pulse generator. The degradation of an electrical characteristic curve of the component by ESD pulses that occur during operation of the electrical component is improved by the pre-aging.

19 Claims, 2 Drawing Sheets

METHOD FOR INCREASING THE ESD PULSE STABILITY OF AN ELECTRICAL COMPONENT

This application is a continuation of co-pending International Application No. PCT/EP2009/059081, filed Jul. 15, 2009, which designated the United States and was not published in English, and which claims priority to German Application No. 10 2008 033 392.1, filed Jul. 16, 2008, both of which applications are incorporated herein by reference.

SUMMARY

In one aspect, the invention discloses a method with which the ESD pulse stability of an electrical component is increased.

In one embodiment, a method for increasing the ESD pulse stability of an electrical component is disclosed. A provided electrical component is pre-aged by means of an aging pulse generated by a pulse generator so that the degradation of an electrical characteristic curve of the component by ESD pulses that occur during operation of the electrical component is reduced.

BRIEF DESCRIPTION OF THE DRAWINGS

The drawings described below are not to scale. Rather, individual dimensions can be depicted as enlarged, reduced, or distorted for improved clarity. Elements that are identical or that perform identical functions are designated by the same reference numeral. The drawings include.

DETAILED DESCRIPTION OF ILLUSTRATIVE EMBODIMENTS

Figure 1:
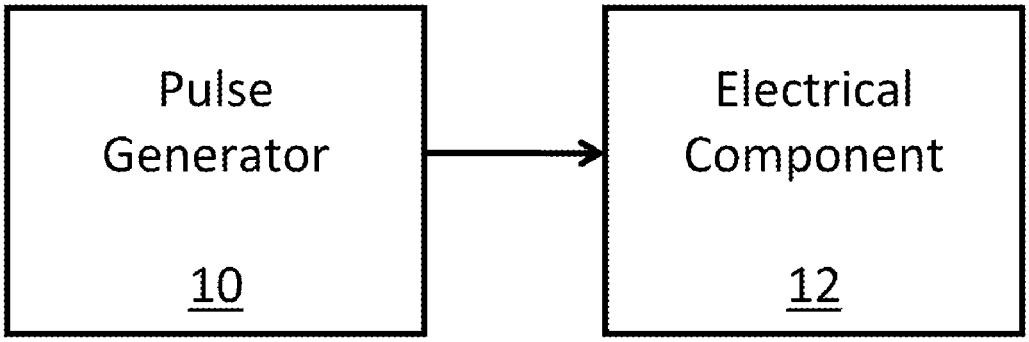
FIG. 1, which shows a block diagram of an electrical component and pulse generator.

Embodiments of the invention relate to a method for increasing the ESD (electrostatic discharge) pulse stability of an electrical component. A provided electrical component is pre-aged by means of an aging pulse generated by a pulse generator. The degradation of an electrical characteristic curve of the component for further ESD pulses that can occur during operation of the electrical component is reduced by the aging pulse.

During operation of electrical components, transient voltage pulses, such as ESD pulses, can lead to a significant degradation of the current-voltage characteristic curve of electrical components. Due to a degradation of the current-voltage characteristic curve, the components thus no longer meet the specifications desired by the customer.

Linear or non-linear resistors are preferably used as the electrical component. Problems due to transient pulses occur particularly for these components, which can lead to a significant degradation of the current-voltage characteristic curve.

At least one electrical parameter of the electrical component is modified by the aging pulse. The ESD degradation of the electrical component is improved by the aging pulse.

Linear or non-linear resistors include, for example, varistors and discrete and integrated resistors.

The varistor voltage of a varistor, for example, can change due to an ESD pulse. The varistor voltage is a typical parameter of varistors. A typical parameter of non-linear resistors is, for example, the ratio of current flowing through the resistor to the voltage applied to the resistor.

Integrated resistors can, for example, be integrated in a multilayer component produced by means of LTCC (low temperature cofired ceramics) technology.

Further, non-linear resistors include, for example, temperature-dependent resistors such as NTCs or PTCs. For NTCs or PTCs, for example, the dependence of the resistance on the temperature can be modified by an ESD pulse.

The ESD degradation of the varistor voltage for a varistor, for example, caused by a 15 kV ESD pulse, for example, is reduced from at least 35% for a non-aged varistor to a maximum of 1% by means of the aging pulse. The varistor voltage is defined as the voltage drop across a varistor with a current of 1 mA.

For discrete resistors, a change of the resistance occurs due to an ESD pulse, which is forestalled by applying an aging pulse.

For PTCs or NTCs, the temperature-dependent resistance characteristic curve is affected by an ESD pulse. By pre-aging by means of an aging pulse, the change is forestalled. With pre-aging of the electrical component by applying an aging pulse, only slight aging occurs in the component during further operation.

The aging pulse preferably comprises a pulse amplitude of approximately 500 V to 8000 V, wherein the pulse comprises a duration of approximately 10 ns to 1000 ns. The aging pulse preferably comprises a rise time of 0.1 ns to 10 ns. The rise time is defined as the time that the pulse requires to change the signal level thereof between two defined intermediate values (typically 10% and 90%). The values given previously for the aging pulse depend very heavily on the design and the materials, such as the ceramics used for the component.

The pulse degradation of the characteristic curve of the electrical component is thus provided by means of an aging pulse, wherein the target specification values of the electrical component are set in a design adjustment. The pulse shape of the aging pulse is preferably selected such that the components are pre-aged by the energy input of the aging pulse, but is not damaged. The aging brought about in further use of the electrical component due to transient pulses, such as ESD, is forestalled by the previously introduced aging pulse, whereby the electrical specification of the component improves.

In one embodiment, the aging pulse is used for a varistor.

The varistor voltage of the varistor is stabilized by the aging pulse. A varistor is a voltage-dependent resistor, abruptly showing a low resistance above a particular threshold voltage typical for each varistor.

Embodiments of the invention further relate to an electrical component showing a maximum ESD degradation of an electrical characteristic curve of 1% after application of a method as described above. The electrical component is a linear or non-linear resistor. Linear or non-linear resistors include, for example, varistors, PTC elements, NTC elements, and discrete or integrated resistors. Integrated resistors are used, for example, in multilayer components produced using LTCC technology.

The terminal voltage of a varistor, for example, can be reduced by approximately 20% by a method described above, if pre-aging has occurred for a varistor.

The terminal voltage is defined as the voltage drop of the varistor that the varistor experiences for a current impulse of greater than 1 A.

The method and subject matters described above are explained in more detail using the following figures and example embodiments.

FIG. 1 provides a block diagram that shows an electrical component 12 that is pre-aged by application of an aging pulse generated by a pulse generator 10.

Figure 2:
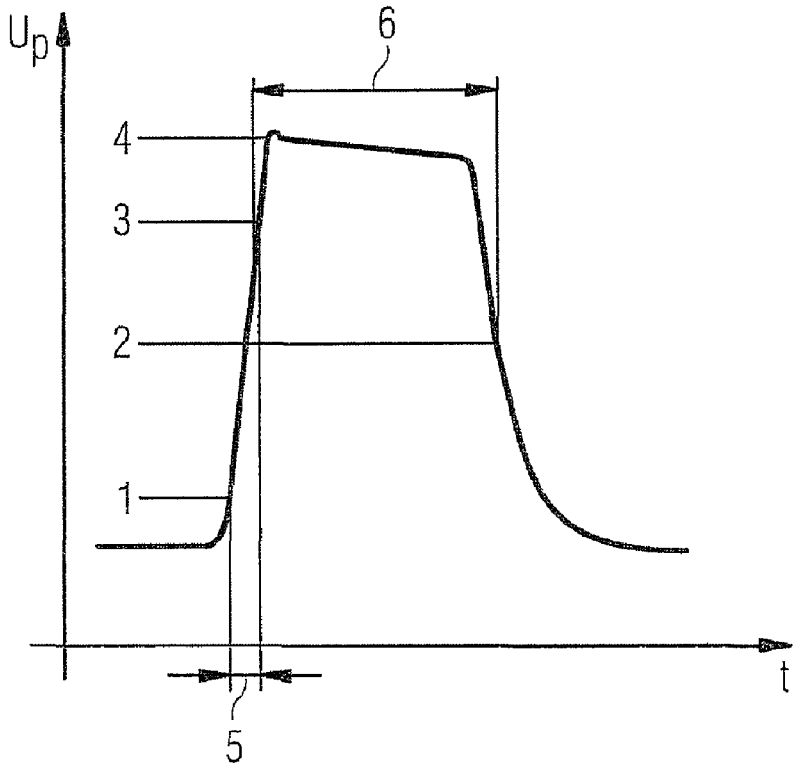
FIG. 2, which shows a schematic profile of an aging pulse.

FIG. 2 shows a schematic profile of an aging pulse. Time is shown on the x-axis, and the voltage of the aging pulse $U_p$ is shown on the y-axis. The aging pulse preferably comprises a maximum pulse amplitude 4 of approximately 500 V to 8000 V, wherein the aging pulse rises from 10% of the pulse amplitude 1 to 90% of the pulse amplitude 3 within a time 5 of approximately 0.1 ns to 10 ns. The pulse length 6 is preferably between 10 ns and 1000 ns. The pulse length 6 is the width of the pulse comprised by the pulse at 50% of the pulse amplitude 2.

As shown in FIG. 1, the aging pulse is preferably generated by means of pulse generator 10. An electrical component 12 is pre-pulsed by means of such an aging pulse. The electrical component 12 is thereby pre-aged by the aging pulse, wherein, however, the component is not damaged. The aging that can occur in subsequent operation of the component 12 is thus nearly completely forestalled by the aging pulse.

Figure 3:
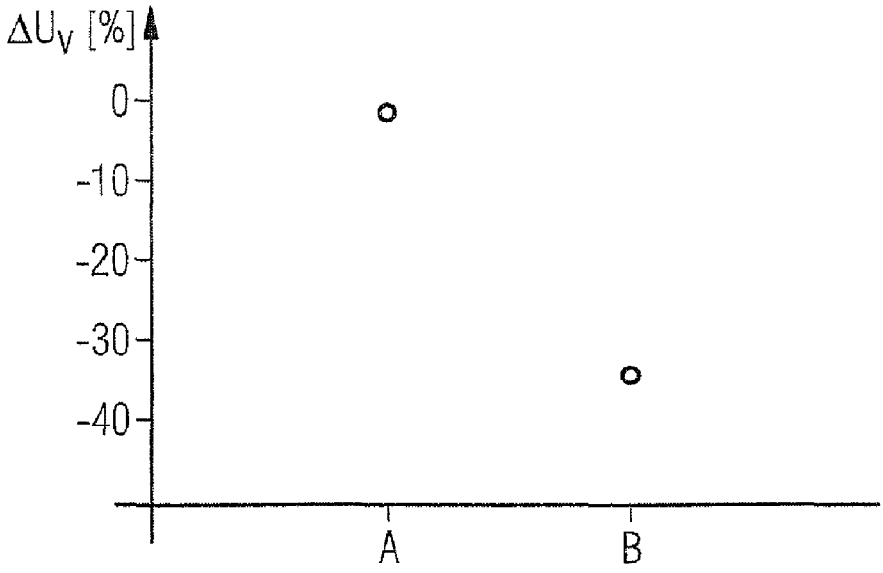
FIG. 3, which shows a diagram of the varistor voltage for aged and non-aged components.

FIG. 3 shows a diagram representing the alteration of the varistor voltage after the effects of an ESD pulse on an electrical component, in this case a varistor. The change in the varistor voltage $\Delta U_v$ in percent is shown on the y-axis.

The varistor voltage is defined as the voltage of a varistor comprised by the varistor when a current of 1 mA is introduced.

The components with the aging pulse A and without the aging pulse B are shown on the x-axis. For a component B that has not been pre-aged by means of an aging pulse, for example, the varistor voltage drops by at least 35% for an ESD pulse of approximately 15 kV, as shown in FIG. 3.

In contrast, if the component A has been pre-aged by means of an aging pulse of 4 kV, for example, the varistor voltage drops by only a maximum of 1%.

Although only a limited quantity of potential further developments of the invention are described in the embodiment examples, the invention is not limited to these examples. It is possible, in principle, that the method can also be applied to other electrical components that age due to transient pulses.

The invention is not limited to the quantity of the elements depicted. The description of the subject matters disclosed here is not limited to the individual specific embodiments; rather, the features of the individual embodiments can be combined with each other arbitrarily to the extent technically feasible.

What is claimed is:

1. A method for increasing ESD pulse stability of an electrical component, the method comprising:

physically changing an electrical component by applying an aging pulse generated by a pulse generator to the electrical component, wherein the aging pulse comprises a pulse amplitude of 500 V 8000 V;

whereby degradation of a current-voltage characteristic curve of the component by ESD pulses that occur during operation of the electrical component is reduced as a result of the applying the aging pulse.

2. The method according to claim 1, wherein the electrical component comprises a linear resistor.

3. The method according to claim 1, wherein the electrical component comprises a non-linear resistor.

4. The method according to claim 1, wherein at least one electrical parameter of the electrical component is modified by the aging pulse.

5. The method according to claim 1, wherein the electrical component ages only slightly during operation after applying the aging pulse.

6. The method according to claim 1, wherein the aging pulse comprises a pulse length of 10 ns to 1000 ns.

7. The method according to claim 1, wherein the aging pulse comprises a rise time of 0.1 ns to 10 ns.

8. The method according to claim 1, wherein the aging pulse comprises a pulse length of 10 ns to 1000 ns, and the aging pulse comprises a rise time of 0.1 ns to 10 ns.

9. The method according to claim 1, wherein the aging pulse is applied to a varistor.

10. The method according to claim 9, wherein the varistor comprises a varistor voltage that is stabilized by the aging pulse.

11. An electrical component having physical characteristics based upon being pre-aged by application of an aging pulse, wherein degradation of a current-voltage characteristic curve of the component by ESD pulses that occur during operation of the electrical component is reduced, the electrical component having a maximum ESD degradation of the current-voltage characteristic curve of 1% after application of the aging pulse compared to an electrical component that is the same except for not having been pre-aged by application of the aging pulse.

12. The electrical component according to claim 11, wherein the electrical component is a varistor.

13. The electrical component according to claim 11, wherein the electrical component is a PTC element.

14. The electrical component according to claim 11, wherein the electrical component is an NTC element.

15. The electrical component according to claim 11, wherein the electrical component has physical characteristics based upon being pre-aged by application of an aging pulse that has a pulse amplitude of 500 V to 8000 V, a pulse length of 10 ns to 1000 ns, and a rise time of 0.1 ns to 10 ns.

16. A method for increasing ESD pulse stability of an electrical component, the method comprising:

generating a pulse by a pulse generator; and applying the pulse to the electrical component;

wherein the generated pulse with a shape such that the electrical component is pre-aged by energy input by the pulse, but the electrical component is not damaged by said energy; and wherein degradation of a current-voltage characteristic curve of the component by ESD pulses that occur during operation of the electrical component is reduced as a result of the applied pulse.

17. The method according to claim 16, wherein the pulse comprises a pulse amplitude of 500 V to 8000 V, a pulse length of 10 ns to 1000 ns, and a rise time of 0.1 ns to 10 ns.

18. The method according to claim 16, wherein the pulse comprises a pulse amplitude of 500 V to 8000 V.

19. A method for pre-aging an electrical component, the method comprising:

applying an aging pulse generated by a pulse generator to the electrical component, wherein the aging pulse comprises a pulse amplitude of 500 V to 8000 V, a pulse length of 10 ns to 1000 ns, and a rise time of 0.1 ns to 10 ns.

* * * * *

UNITED STATES PATENT AND TRADEMARK OFFICE

CERTIFICATE OF CORRECTION

PATENT NO. : 8,294,547 B2
APPLICATION NO. : 13/007078
DATED : October 23, 2012
INVENTOR(S) : Feichtinger et al.

It is certified that error appears in the above-identified patent and that said Letters Patent is hereby corrected as shown below:

In Col. 3, line 53, claim 1, delete "500 V 8000 V" and insert --500 V to 8000 V--.

Signed and Sealed this
Nineteenth Day of March, 2013

Teresa Stanek Rea
*Acting Director of the United States Patent and Trademark Office*